US007436419B2

(12) United States Patent
Ogawa

(10) Patent No.: US 7,436,419 B2
(45) Date of Patent: Oct. 14, 2008

(54) CONSUMABLE CASSETTE AND RECORDING APPARATUS

(75) Inventor: Toshihiro Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 11/672,718

(22) Filed: Feb. 8, 2007

(65) Prior Publication Data

US 2007/0195155 A1 Aug. 23, 2007

(30) Foreign Application Priority Data

Feb. 17, 2006 (JP) ..... 2006-040627
Jan. 24, 2007 (JP) ..... 2007-013383

(51) Int. Cl.
*B41J 17/32* (2006.01)

(52) U.S. Cl. ..... 347/214; 400/208; 400/208.1

(58) Field of Classification Search ..... 347/214; 400/207, 208, 208.1
See application file for complete search history.

(56) References Cited

U.S. PATENT DOCUMENTS 5,216,441 A * 6/1993 Isobe ..... 347/214
6,069,642 A * 5/2000 Isobe ..... 347/176
6,522,349 B1 * 2/2003 Lee ..... 347/214
2007/0195148 A1 8/2007 Ogawa

FOREIGN PATENT DOCUMENTS

| | | |
|---|---|---|
| JP | 62-087368 | 4/1987 |
| JP | 62-151370 | 7/1987 |
| JP | 4-065270 | 3/1992 |

* cited by examiner

*Primary Examiner*—Huan H Tran
(74) *Attorney, Agent, or Firm*—Fitzpatrick, Cella, Harper & Scinto

(57) ABSTRACT

In a consumable cassette having a recording material storage section 2 and an ink sheet storage section 1, a space 65 where a constituting component such as a supply roller 56 is to be disposed is formed in the cassette, when the cassette is attached to a recording apparatus. A movable member is movably disposed to cover the space, when the cassette is removed from the recording apparatus. Therefore, rigidity of the cassette is improved.

10 Claims, 5 Drawing Sheets

CONSUMABLE CASSETTE AND RECORDING APPARATUS

BACKGROUND OF THE INVENTION

1. Field of the Invention

The present invention relates to a consumable cassette configured to store a recording material and an ink sheet, and a recording apparatus including a recording mechanism to which a consumable cassette is attached and which records an image on a recording material. The present invention more particularly relates to a consumable cassette including a space portion to be combined with a recording mechanism, and a recording apparatus including an attaching portion to which a consumable cassette is detachably attached.

2. Description of the Related Art

A recording apparatus has functions of a printer, a photocopier and a facsimile machine, and is configured to allow a recording head as a recording unit to record an image (including characters and symbols) on a recording material such as a recording sheet based on image information. As the recording material, various sheet materials are used such as paper, cloth, a plastic sheet and a sheet for OHP. There are recording apparatuses including recording systems of a serial type and a linear type. In the serial type, while main scanning to move the recording head along the recording material is repeated alternately with sheet feeding (sub-scanning) of the recording material, the image is recorded. On the other hand, in the linear type, an elongated recording head extends in a width direction of the recording material. While an image for one line is recorded together by use of the head, the only sheet feeding of the recording material (the sub-scanning) is performed to record the image.

Moreover, the recording apparatus can be classified into recording systems of a thermal transfer type, a heat sensitive type, an ink jet type, a laser beam type and a wire dot type. Among these systems, in the thermal transfer system (a thermal transfer recording apparatus), a recording material is brought into contact under pressure with a recording head via an ink sheet. While the ink sheet is run synchronously with conveyance of the recording material, ink is heated and transferred so as to record the image. There are a sublimation type and a melting type of thermal transfer recording apparatuses. In a recording apparatus to transfer the ink as in the thermal transfer recording apparatus, as consumables, an ink sheet impregnated with the ink and the recording material to which the ink is to be transferred are used. In general, a conventional recording apparatus is adapted to store the ink sheet and the recording material in exclusive-use cassettes, respectively. These cassettes are loaded to the recording apparatus from separate directions, respectively.

For example, Japanese Utility Model Application Laid-Open No. H01-139563 discusses an ink sheet storage section to store an ink sheet. A cassette configuration of the section is proposed in which the ink sheet is stored and which is detachably attached to a recording apparatus. In this example, an opening is disposed in a part of the cassette so as to bring the surface of the ink sheet coated with ink into contact with a recording material. When an ink sheet cassette is handled, dust and fingerprint are sometimes attached to the ink coated surface of the ink sheet via this opening.

On the other hand, in a proposed construction of a recording material storage section to store the recording material, a user opens a package containing the ink sheet cassette and a bundle of recording materials, and takes out the recording material to transfer the material to a cassette for exclusive use prepared separately. Moreover, the exclusive-use cassette containing the recording material is attached to the recording apparatus to constitute the recording material storage section. A recording surface of this type of recording material is generally set so as to improve a fixing property of the ink and achieve high-quality image formation. To record an appropriate image, front and back surfaces of the recording material need to be confirmed, and a recording surface needs to be directed in a predetermined direction and stored in the cassette. Therefore, when the recording material is stored in another cassette for exclusive use, many complicated preparing operations are required. When the material is transferred from the package to the cassette, attention needs to be paid so that fingerprint and dust are not attached to the recording surface. Therefore, it cannot be said that this construction has an excellent handing property.

In the construction in which the recording material is stored in the cassette for exclusive use in this manner, during an operation to store the recording material, dirt (attachment of dust, garbage and fingerprint) and a crack (deformation, breakage) are easily generated on the recording surface of the recording material. The dirt and crack are a cause for deterioration of an image quality of the recorded image.

In addition, in this type of recording apparatus, it is expected that a user arbitrarily selects various finishes such as color photograph print, print for exclusive use in a monochromatic photograph and seal and various sizes (a postcard size, an L-size, a 2L-size, etc.) to perform printing. To execute optimum recording which meets user's expectation, a corresponding type of combination of the ink sheet and the recording material can be used in accordance with the finish. When the printing is not performed based on the optimum combination, the expected finish is not achieved. The image cannot be recorded as expected in accordance with an original performance, or the recording is not easily achieved in some case.

Therefore, when the recording material and the ink sheet are handled by use of the separate cassettes for exclusive use, the user needs to select the ink sheet cassette and the recording material cassette so as to appropriately cope with the recording. However, the user might make a mistake in selecting the appropriate combination.

For example, the ink sheet cassette for exclusive use in the monochromatic photograph is combined with the recording material cassette for exclusive use in the monochromatic photograph in which gradation of the monochromatic photograph can sufficiently be achieved. After the recording is performed with this combination, the ink sheet cassette is replaced with a chromatic ink sheet cassette for a purpose of printing the color photograph, but the user forgets to replace the recording material cassette. In such an assumed case, color development in a printed matter might not be obtained as expected.

In future, the recording in which this type of recording apparatus is utilized is expected to enlarge. There is a possibility of increase of types of usable consumables which meet user's requirements. In such a case, it is necessary to determine an appropriate combination of the recording material cassette and the ink sheet cassette. Alternatively, it is necessary to determine the types of the ink sheet cassette and the recording material cassette attached to the recording apparatus and to notify whether or not the combination is appropriate. Therefore, a situation is caused in which a new determination unit and a new notification unit are required for transmission of information to a printer side.

When the ink sheet cassette and the recording material cassette are independently and individually handled, respectively, problems of storing properties of the cassettes cannot be ignored. That is, when the cassettes are removed from the recording apparatus and stored, one of the ink sheet cassette and the recording material cassette is easily lost. To use a different type of recording material, the recording material which is not used needs to be taken out of the cassette for exclusive use. The user has to prepare a storage member or space for storing this taken recording material.

Several proposals have been made in order to solve a problem and obviate an inconvenience in a case where the cassettes for exclusive use in the ink sheet and the recording material are individually used as described above, respectively.

One of the proposals is that the ink sheet and the recording material be stored in one cassette to handle an integrated consumable cassette. According to this proposal, two types of consumables, that is, the ink sheet and the recording material are stored in one cassette. Two types of consumables can be integrated and loaded to the recording apparatus from one common direction (e.g., a side surface of the recording apparatus). Therefore, a handling property of the consumable cassette can be improved.

As examples of such an integrated construction, Japanese Patent Application Laid-Open Nos. S62-87368 and S62-151370 discuss a consumable cassette in which a recording material storage section and an ink sheet storage section are arranged in a longitudinal direction of a recording material (a direction along a conveyance direction). In consequence, the handing property can be improved. In addition, the cassette can be thinned. Japanese Utility Model Application Laid-Open No. H02-44058 discusses an ink sheet cassette in which a supply side of an ink sheet is disposed close to a wind-up side, thereby realizing miniaturization of the ink sheet storage section.

As another example, Japanese Patent Application Laid-Open No. H04-65270 discusses a cassette structure of a thermal transfer recording apparatus having excellent consumable storing property and space saving property. In this example, when a recording material cassette and an ink sheet cassette are not attached to a printer, the cassettes are stacked. To attach both the cassettes to the printer, the cassettes are opened and arranged in parallel.

However, according to the constructions of the consumable cassettes described in the above publications, when the cassette is loaded to the recording apparatus in a recordable state, the ink sheet storage section is disposed in parallel with the recording material storage section along a supply direction of a recording material conveyance path. The sections are arranged in substantially the same plane.

Therefore, since the recording apparatus includes a conveyance mechanism of the ink sheet, a conveyance mechanism of the recording material and further the recording head, an installation area of the apparatus necessarily enlarges. That is, the maximum installation area of the recording apparatus including the attached consumable cassette for use is not smaller than a size obtained by adding up an arrangement area of the storage section in which the recording material having the maximum size is stored and an arrangement area of the storage section of the ink sheet.

In addition, a factor for the enlargement of the installation area of the apparatus is extension of the apparatus caused by disposing the ink sheet storage section in a direction in which the recording material is conveyed in addition to the recording material storage section as disclosed in, for example, Japanese Patent Application Laid-Open No. H04-65270. In many cases, this portion extended along the supply direction corresponds to a longitudinal direction of the recording material. Therefore, such dimensional inclination of the structure in the longitudinal direction is a factor for destroying a balance between the installation area of the recording apparatus and a height direction of the apparatus.

Moreover, as disclosed in Japanese Patent Application Laid-Open No. H04-65270, there is a peculiar problem in a case where a configuration of the cassette changes. For example, the cassette has different constructions during the storage and during the recording. That is, in this case, every time the cassette is loaded to or removed from the recording apparatus, such an excess operation as to change the configuration of the cassette, for example, an opening/closing operation is required.

The operation is manually or electromotively performed to change the configuration of the cassette to a state of the stored cassette or a state of the cassette during a recording operation.

Especially, as disclosed in Japanese Patent Application Laid-Open No. H04-65270, when the cassette is removed from the recording apparatus, the recording material and the ink sheet are exposed and opened. Therefore, the dirt (the attachment of the dust and fingerprint) and the crack (the deformation, the breakage) are easily generated on the recording material and the ink sheet. When the cassette is attached to the recording apparatus, the ink sheet and the recording material need to be adjusted into appropriate states in a recording position. It is expected that a long time is required until the recording operation is restarted.

SUMMARY OF THE INVENTION

The present invention has been developed in view of the above technical problem.

An object of the present invention is to provide a consumable cassette which can easily be loaded to a recording apparatus from one direction in the form of the consumable cassette constituted by integrating a recording material storage section and an ink sheet storage section and which can be configured so as to save a space and which can contribute to miniaturization of the recording apparatus.

Moreover, an object of the present invention is to provide a consumable cassette which is excellent in protecting a recording material and an ink sheet at a time when the cassette is removed from a recording apparatus.

Furthermore, an object of the present invention is to provide a consumable cassette which can quickly and securely be attached to a recording apparatus and which has an excellent handling property.

In addition, an object of the present invention is to provide a recording apparatus including a miniaturized construction in which an operable portion of a consumable cassette can be operated at a time when the consumable cassette is attached or detached.

To achieve the above objects, a consumable cassette of the present invention comprises: a recording material storage section to store a recording material; and an ink sheet storage section to store an ink sheet, the consumable cassette being detachably attached to a recording apparatus, the recording material storage section and the ink sheet storage section being stacked and being provided with a space formed between the recording material storage section and the ink sheet storage section in a state in which the consumable cassette is attached to the recording apparatus so that a part of a recording mechanism of the recording apparatus is disposed in the space, the consumable cassette further comprising: a movable member being movable so as to cover the space when the consumable cassette is removed from the recording apparatus and to open the space when the consumable cassette is attached to the recording apparatus. Moreover, a recording apparatus of the present invention comprises: a loading section to which a consumable cassette is to be loaded, the consumable cassette comprising: a recording material storage section to store a recording material; and an ink sheet storage section to store an ink sheet, the recording apparatus further comprising a recording mechanism including a recording material conveyance mechanism which operates the recording material storage section, an ink sheet conveyance mechanism which operates the ink sheet storage section and a recording head, and an operation mechanism which allows a movable member to cover a space, when the consumable cassette is removed from the recording apparatus, and to open the space, when the consumable cassette is attached to the recording apparatus, the space being formed between the recording material storage section and the ink sheet storage section in a state in which the consumable cassette constituted by stacking the recording material storage section and the ink sheet storage section is attached to the recording apparatus, a part of the recording mechanism of the recording apparatus being disposed in the space.

According to the present invention, the consumable cassette is provided with the space where components constituting the recording apparatus are arranged at a time when the cassette is attached to the recording apparatus. There is not a difference of a size of a main structure between the state in which the cassette is attached to the recording apparatus and a non-attached state in which the cassette is removed from the recording apparatus. The consumable cassette of the present invention includes the movable member which covers the space, when the cassette is removed from the recording apparatus. The movable member is movable so as to improve rigidity of the consumable cassette. In the non-attached state, dust and fingerprint can be inhibited from being attached to the ink sheet and the recording material.

The present invention is directed to the consumable cassette which can easily supply the recording material and the ink sheet to the recording apparatus from one direction and which can be constituted so as to save a space and advantageously contribute to miniaturization of the recording apparatus. The consumable cassette can quickly and securely be attached to the recording apparatus, and has an excellent handling property. Furthermore, when the consumable cassette is removed from the recording apparatus, the recording material and the ink sheet can be protected in a state in which dirt or crack is not easily generated. This can improve reliability of the consumable cassette.

Moreover, it is possible to provide a miniaturized recording apparatus including a construction capable of operating the operating portion of the consumable cassette at a time when the consumable cassette is attached or detached.

Further features of the present invention will become apparent from the following description of exemplary embodiments with reference to the attached drawings.

BRIEF DESCRIPTION OF THE DRAWINGS

FIG. 3A illustrates that the cassette is removed from a recording apparatus, FIG. 3B is a perspective view from which the recording apparatus is omitted and which illustrates that the cassette is disposed in the recording apparatus, and FIG. 3C is a perspective view illustrating a state as viewed from a direction reverse to that of FIG. 3B, the recording apparatus being omitted from FIG. 3C.

FIG. 4A illustrates that the cassette is removed from a recording apparatus, FIG. 4B is a perspective view from which the recording apparatus is omitted and which illustrates that the cassette is disposed in the recording apparatus, and FIG. 4C is a schematic diagram viewed from a side surface.

FIG. 5A illustrates that the cassette is removed from a recording apparatus, and FIG. 5B is a perspective view from which the recording apparatus is omitted and which illustrates that the cassette is disposed in the recording apparatus.

FIG. 6A illustrates that the cassette is removed from a recording apparatus, and FIG. 6B is a perspective view from which the recording apparatus is omitted and which illustrates that the cassette is disposed in the recording apparatus.

DESCRIPTION OF THE EMBODIMENTS

Figure 1:
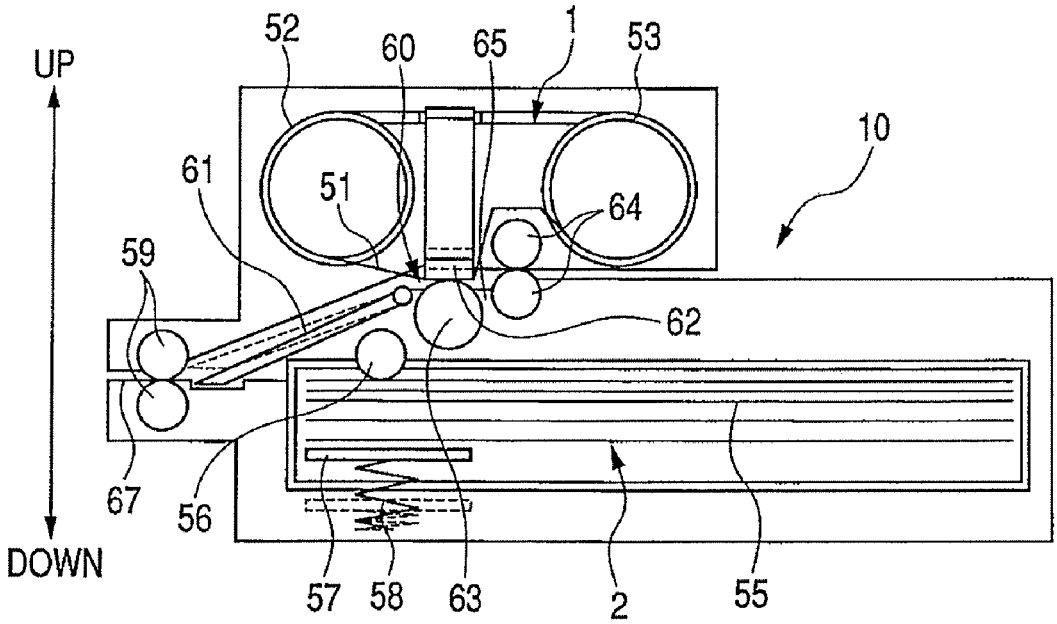
FIG. 1 is a schematic diagram of an exemplary recording apparatus in which a consumable cassette is to be used according to the present invention as viewed from a side surface.
Figure 2:
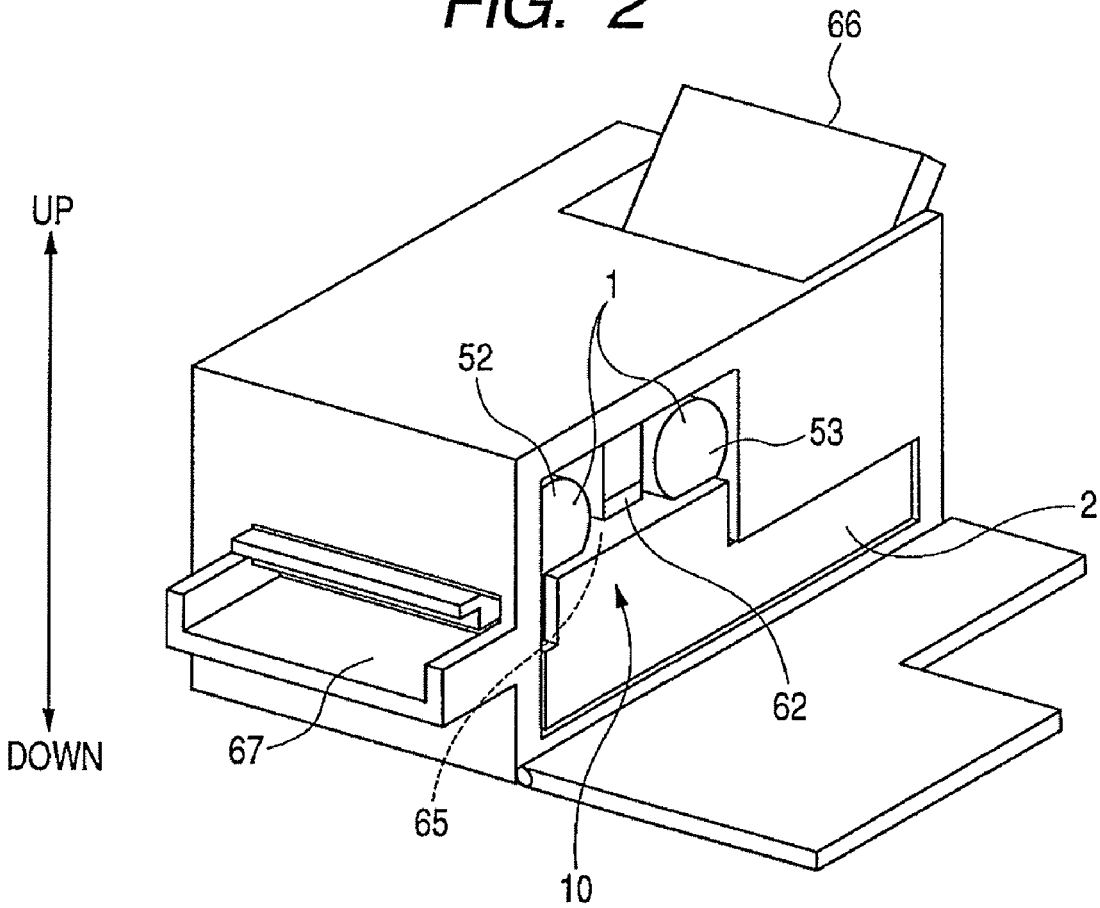
FIG. 2 is a perspective view schematically illustrating an exemplary recording apparatus in which the consumable cassette is to be used according to the present invention.

Embodiments of the present invention will hereinafter be described specifically with reference to the drawings. It is to be noted that in the drawings, the same reference numerals are the same or corresponding components. FIG. 1 is a schematic diagram illustrating a schematic construction of an exemplary recording apparatus in which a consumable cassette is to be used according to the present invention. FIG. 2 is a perspective view illustrating a schematic construction of an exemplary recording apparatus in which the consumable cassette is to be used according to the present invention. In FIGS. 1 and 2, the illustrated recording apparatus drives a heat generation element of a thermal head (a recording head) as a recording unit based on image information. Ink with which an ink sheet is impregnated is melted and transferred to a recording material such as a recording sheet to thereby record an image. An ink sheet 51 is wound around a supply roll of a supply roll storage section 52 and a windup roll of a windup roll storage section 53 in a cassette-like ink sheet storage section 1. A plurality of recording materials 55 are stacked and stored in a recording material storage section 2.

The ink sheet storage section 1 is partially integrally connected to the recording material storage section 2 as described later to constitute a consumable cassette 10. The ink sheet storage section 1 is disposed so as to be superimposed upon a direction in which the recording materials are stacked in the recording material storage section 2, the direction being assumed as a reference direction (assuming that a vertical (up-down) direction shown by an arrow in FIG. 1 is the reference direction, the ink sheet storage section is disposed so as to be stacked on the recording material: the embodiments will be described assuming that a vertical direction of a shown state meets the vertical direction shown by the arrow of FIG. 1 unless otherwise mentioned). In an upper part of a recording material sending section of the recording material storage section 2, a supply roller (a pickup roller) 56 is disposed which separately sends out the recording material sheet by sheet. Under the recording material storage section 2, a pressure plate 57 and a pressure leaf spring 58 are arranged so as to bring the stacked recording materials 55 into contact under pressure with the supply roller 56. The recording material 55 sent out by the supply roller 56 is sandwiched between a pair of first conveyance rollers 59 arranged in a conveyance path 67. The material is then conveyed to an image recording section 60 along a guide member 61 by the pair of first conveyance rollers 59.

The guide member 61 is formed of a plate-like member disposed in a switchable position. The member forms a conveyance path leading to the image recording section 60 in a position shown by a solid line, and forms a conveyance path leading from the supply roller 56 to the pair of first conveyance rollers 59 in a position shown by a chain line. That is, in the present embodiment, a rotation driving direction of the pair of first conveyance rollers 59 is controlled so as to convey the recording material 55 from the recording material storage section 2 to the image recording section 60 by switchback conveyance. The image recording section 60 includes a recording head 62 and a platen roller 63. On a downstream side of a conveyance direction of the platen roller 63, a pair of second conveyance rollers 64 are arranged.

The recording material 55 having the image recorded thereon by the image recording section 60 is discharged onto a discharge tray 66 (FIG. 2) disposed in a rear upper part of a recording apparatus main body by the pair of second conveyance rollers 64. Therefore, the conveyance path of the recording material 55 is the recording material storage section 2→ a conveyance path 67→ the guide member 61→ the image recording section 60→ the discharge tray 66. The recording material 55 is reciprocated between the conveyance path 67 and the discharge tray 66 to enable color image recording so that colors are superimposed upon one another. To perform the recording, a space 65 is disposed between the recording material storage section 2 and the ink sheet storage section 1 in the consumable cassette 10. This space 65 contains a part of components constituting the recording apparatus such as the supply roller 56, the recording head 62, the platen roller 63 and the pair of second conveyance rollers 64.

In FIG. 2, an openable cover (or a side plate) 68 is attached to one side surface of the recording apparatus. When the cover 68 is opened, the consumable cassette 10 can be disposed in the recording apparatus, or taken out of the recording apparatus. That is, the integrated consumable cassette 10 containing the ink sheet 51 and the recording material 55 is detachably attached to the one side surface of the recording apparatus.

FIGS. 3A to 6B illustrate exemplary embodiments of the integrated consumable cassette to which the present invention is applied and in which the ink sheet and the recording material are stored.

First Embodiment

Figure 3A:
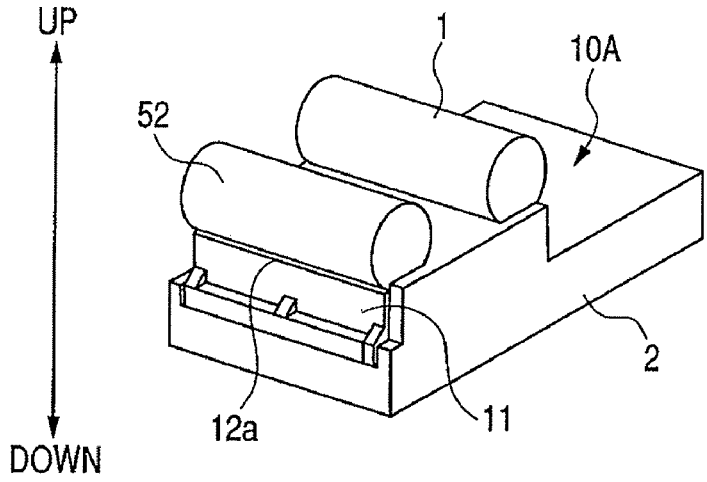
FIGS. 3A, 3B and 3C are perspective views schematically illustrating a first embodiment of the consumable cassette according to the present invention.
Figure 3B:
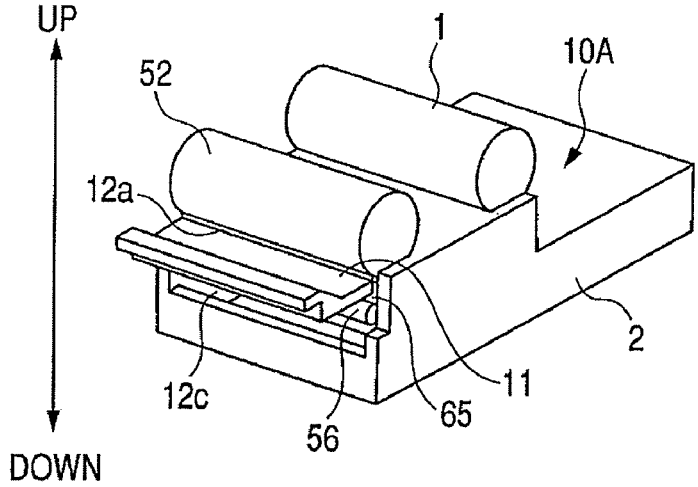
Figure 3C:
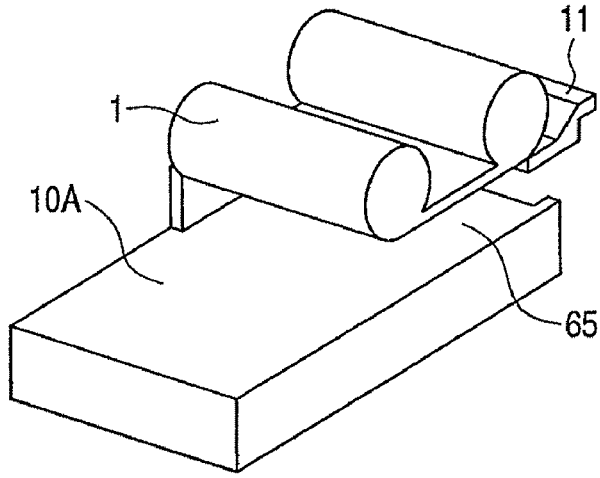

FIGS. 3A to 3C are perspective views of the first embodiment of a consumable cassette according to the present invention, FIG. 3A illustrates that the cassette is removed from a recording apparatus, FIG. 3B illustrates that the cassette is disposed in the recording apparatus in a state in which the recording apparatus is omitted, and FIG. 3C is a perspective view illustrating a state viewed from a direction reverse to that of FIG. 3B, the recording apparatus being omitted. In FIGS. 3A to 3C, a rotary member 11 as a movable member is disposed between an ink sheet storage section 1 and a recording material storage section 2 of a consumable cassette 10A. This rotary member 11 covers a space (not shown in FIGS. 3A to 3C, see a space 65 of FIG. 1) which is present in the consumable cassette 10A. Moreover, the member constitutes a reinforcing member which reinforces a structure of a cassette housing of the consumable cassette 10A. The ink sheet storage section and the recording material storage section are arranged in a vertical direction (see an arrow in FIGS. 3A to 3C) so as to sandwich the rotary member 11. On a side on which a supply roll storage section 52 constituting the ink sheet storage section 1 is disposed, the rotary member 11 is disposed so as to openably close a front opening 12*c* which is an outlet of the recording material sent from the recording material storage section 2 for switchback.

This rotary member 11 is rotatably connected to a rotary shaft portion 12*a* disposed in a direction crossing (usually at right angles) a direction in which the consumable cassette is attached to or detached from the recording apparatus. This rotary shaft portion 12*a* is rotatable between a closed position having an angle (0 degree) at a time when the consumable cassette is removed from the recording apparatus as shown in FIG. 3A and an opened position having an angle (90 or more degrees) at a time when the consumable cassette is disposed in the recording apparatus as shown in FIG. 3B. In the closed position shown in FIG. 3A, the space 65 formed between the ink sheet storage section 1 and the recording material storage section 2 is closed. The rotary shaft portion 12*a* is provided with an urging unit such as a torsion spring which moves the rotary member 11 from the opened position of FIG. 3B to the closed position of FIG. 3A. This urging unit quickly moves the consumable cassette 10A from an opened state of FIG. 3B to a closed state of FIG. 3A.

It is to be noted that, as shown in FIG. 3C, when the consumable cassette is attached to the recording apparatus, an operation member of the cassette on an opposite side is brought into the opened state so that a conveyance mechanism and a recording mechanism of the recording apparatus are inserted into a space portion of the consumable cassette.

In a state in which the cassette is removed from this recording apparatus, the rotary member 11 functions as a support which keeps a constant distance between the ink sheet storage section 1 and the recording material storage section 2. Moreover, the rotary member functions as a closing member (a lid) which covers a recording material takeout opening of the recording material storage section 2. That is, when the consumable cassette is taken out and stored, the rotary member 11 shields, from the outside, one side surface of the space 65 existing between the recording material storage section 2 and the ink sheet storage section 1. Therefore, the recording material and the ink sheet are prevented from being touched by a user by mistake.

The above-described embodiment is directed to the consumable cassette by which the recording material and the ink sheet can easily be loaded to the recording apparatus from one direction. In addition, the cassette can be configured so as to save a space. Therefore, the cassette is advantageous for miniaturization of the recording apparatus. Since the consumable cassette can quickly and securely be attached to the recording apparatus, the cassette has an excellent handling property. Furthermore, when the consumable cassette is removed from the recording apparatus, the cassette can be protected in a state in which dirt (attachment of dust and fingerprint) and a crack (deformation and breakage) are not easily generated on the recording material and the ink sheet. Therefore, reliability of the consumable cassette can be improved.

The consumable cassette 10A has a structure in which the recording material and the ink sheet are stored and integrated.

Therefore, according to the consumable cassette of the present embodiment, these two types of consumables can easily be attached to or detached from the recording apparatus from one direction. Moreover, a movable member including the rotary member 11 as described in the first embodiment is urged by an urging unit such as a spring in a direction from the opened position to the closed position. Therefore, when the consumable cassette is removed from the recording apparatus, the movable member functions so as to close the space between the ink sheet storage section 1 and the recording material storage section 2. Moreover, the member functions so as to improve rigidity of the cassette.

Furthermore, the consumable cassette has a cantilever structure such as a beam having one end fixedly supported and the other end being free. In such a structure, when a load acts on a free end side, the maximum moment is generated on a fixed end side. Therefore, attention needs to be paid to the load which acts on the free end side. In the consumable cassette, such strength as to bear impact during falling needs to be secured at minimum. In an efficient construction which meets these conditions, a reinforcing member is disposed so as to reinforce the ink sheet storage section and the recording material storage section. This reinforcing member may be sandwiched between both of the storage sections, or both of the storage sections may be wrapped with this reinforcing member. The movable member of each embodiment (the rotary member 11 of the first embodiment) constitutes this reinforcing member. Moreover, when the consumable cassette is attached to the recording apparatus, this reinforcing member needs to be movable to a retracted position where the space between the recording material storage section and the ink sheet storage section is opened.

In the consumable cassette in which the recording material storage section and the ink sheet storage section are integrated, there are two movement directions in which the reinforcing member is retracted, that is, a recording material conveyance direction (e.g., a recording apparatus front surface direction) and a direction crossing this conveyance direction at right angles (e.g., a recording apparatus side surface direction). The first and second embodiments of FIGS. 3A to 3C and FIGS. 4A to 4C illustrate a construction in which the movable member (the reinforcing member) moves (retracts) in the recording material conveyance direction with respect to the recording apparatus. The third and fourth embodiments of FIGS. 5 and 6 illustrate a construction in which the movable member (the reinforcing member) moves in the direction crossing (e.g., at right angles) the recording material conveyance direction with respect to the recording apparatus.

Moreover, according to the embodiments, the consumable cassette is attached to or detached from the recording apparatus from the direction (e.g., the side surface of the recording apparatus) crossing (e.g., at right angles) the recording material conveyance direction.

Here, an effective means for separating the recording material storage section and the ink sheet storage section from each other is a sliding movement of the cassette on an inclined surface disposed on, for example, the side surface of the recording apparatus. Two parallel planes come into contact with each other at a certain or more angle in a state in which the planes are not parallel to each other or do not cross each other at right angles. In this case, slippage is generated on the surfaces, and the surfaces slide on each other. When this sliding movement is performed, at least one component is moved. Especially, a rotatable member rotates, and a slidable member slides. When this sliding surface is disposed on the side surface of the recording apparatus, the movable member brought into contact with this sliding surface moves, and is guided to an appropriate position.

Furthermore, an effective uniting means is urging performed by an elastic member such as the torsion spring or a coil spring. When the component is urged beforehand by the elastic member, the slid component undergoes a reactive force of the elastic member and tries to return to an original position. Therefore, when the cassette is discharged, the sliding surface brought into contact with the component leaves the component. Moreover, the surface can shift to a state before the cassette is loaded.

When the sliding surface and the urging performed by the elastic member are utilized in this manner, an operation to be performed by the user can be minimized. A handling property of the consumable can further be improved.

Moreover, the movable member has such a shape as to function as a lid or a pressing member of the recording material storage section and the ink sheet storage section. When the cassette is loaded, a portion having the shape slides along a guide portion on a recording apparatus side. In consequence, the space 65 between the recording material storage section and the ink sheet storage section is opened. Therefore, components (a supply roller, a platen roller, a recording head, etc.) constituting the recording apparatus for purposes of conveyance and recording are arranged in the space. This is advantageous for effective utilization of the space and miniaturization of the apparatus.

Especially, a supply roller 56 disposed in an opening portion of the recording material storage section 2 is an exemplary constituting component disposed in the space 65. In the embodiments, an ink sheet 51 and a recording material 55 are not especially illustrated. An effective means for moving the movable member in a direction in which the space 65 is opened is, for example, an operation performed by the user or a sliding guide portion of the recording apparatus. As an exemplary means for moving the movable member in a direction in which the space is closed is, for example, the operation performed by the user or urging performed by the torsion spring.

Second Embodiment

Figure 4A:
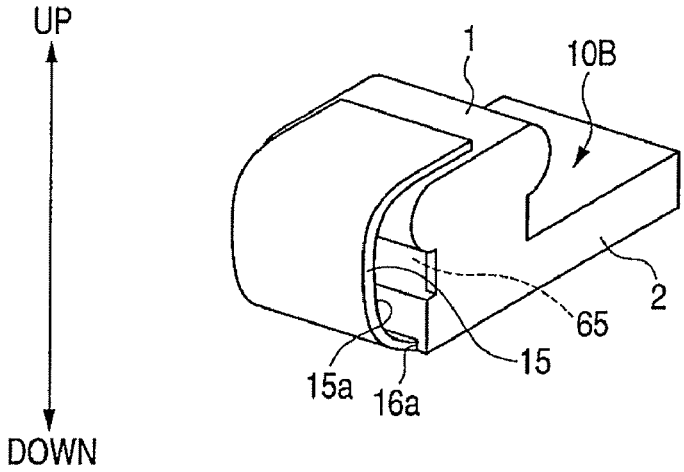
FIGS. 4A, 4B and 4C are perspective views schematically illustrating a second embodiment of the consumable cassette according to the present invention.
Figure 4B:
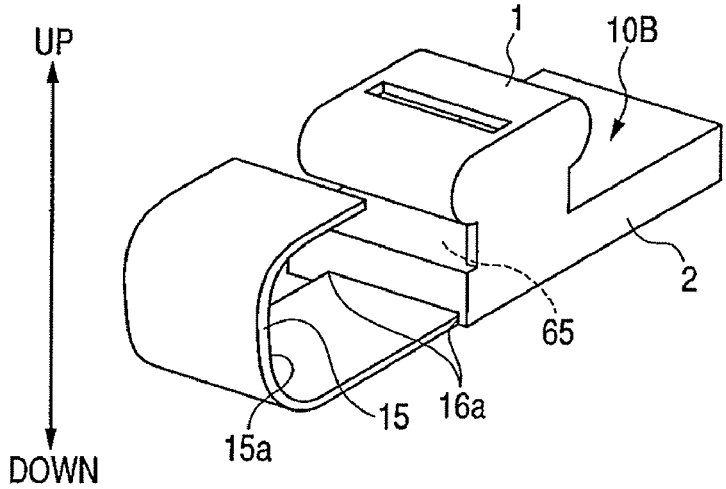
Figure 4C:
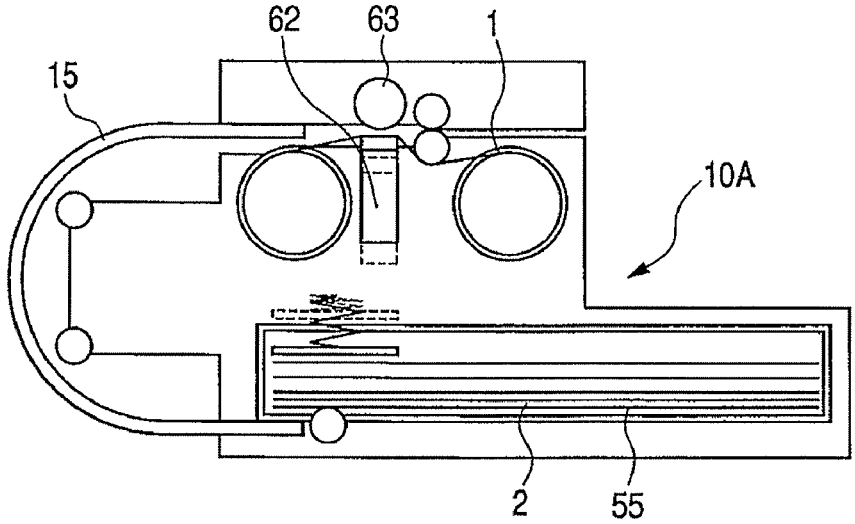

FIGS. 4A to 4C are perspective views illustrating the second embodiment of a consumable cassette according to the present invention, FIG. 4A illustrates that the cassette is removed from a recording apparatus, FIG. 4B illustrates that the cassette is disposed in the recording apparatus in a state in which the recording apparatus is omitted, and FIG. 4C is a schematic diagram illustrating that the cassette of the second embodiment is attached to the recording apparatus as viewed from a side surface. In FIGS. 4A to 4C, a curved member 15 is provided to extend upwards from a recording material storage section 2 in a curved state so as to cover an ink sheet 51 in an ink sheet storage section 1 of a consumable cassette 10B. This curved member 15 is slidably attached so as to be movable in a recording material conveyance direction by a sliding guide portion 16*a*. The curved member constitutes a reinforcing member of the cassette including a movable member. The ink sheet storage section 1 is disposed in a height direction (a front/back surface direction of a recording material) of the recording material storage section 2 so that the ink sheet storage section is wrapped with the curved member 15. Moreover, the curved member 15 is movable so as to come close to or come away from an end surface of the recording material storage section 2 on an opening side from the recording material conveyance direction.

Moreover, the curved member 15 is urged so as to be retracted toward the recording material storage section by an urging member such as a coil spring. When the curved member is retracted, a space 65 between the ink sheet storage section 1 and the recording material storage section 2 can be closed.

When the consumable cassette 10B is attached to the recording apparatus, the curved member 15 is guided or moved by a member of the recording apparatus. In consequence, the curved member is moved against the urging member toward an opened position of FIG. 4B. On the other hand, when the consumable cassette 10B is removed from the recording apparatus, the curved member 15 is quickly moved to a closed position of FIG. 4A by the urging member to function as a lid member and a reinforcing member. In the present embodiment, in the opened position of FIG. 4B, the curved member 15 forms a part of a conveyance path to guide the recording material sent from the recording material storage section 2. That is, while the recording material sent by a supply roller 56 constituting the recording apparatus is guided by a curved surface 15*a* of the curved member 15, the material is conveyed toward an image recording section 60 of the recording apparatus. In the image recording section, a recording head 62 is brought into contact under pressure with the ink sheet 51 to thereby transfer and record an image.

Even the present embodiment is directed to the consumable cassette by which the recording material and the ink sheet can easily be loaded to the recording apparatus from one direction. In addition, the cassette can be constituted so as to save a space. Therefore, the cassette is advantageous for miniaturization of the recording apparatus. The consumable cassette can quickly and securely be attached to the recording apparatus, and has an excellent handling property. Furthermore, when the consumable cassette is removed from the recording apparatus, the recording material and the ink sheet can be protected in a state in which dirt (attachment of dust and fingerprint) and crack (deformation and breakage) are not easily generated. This can improve reliability of the consumable cassette.

Third Embodiment

Figure 5A:
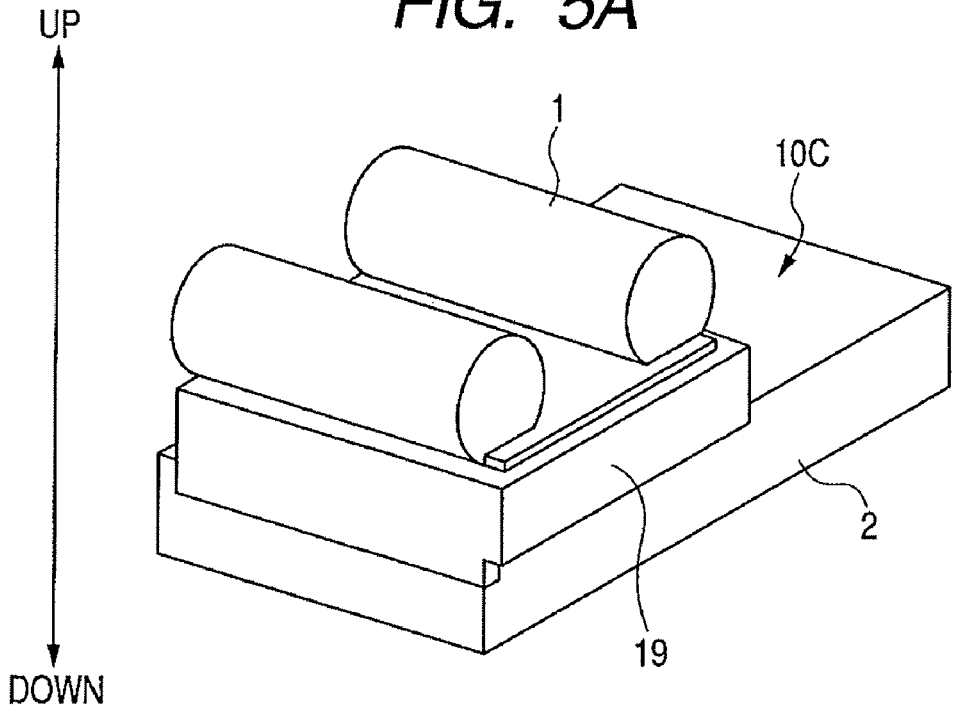
FIGS. 5A and 5B are perspective views schematically illustrating a third embodiment of the consumable cassette according to the present invention.
Figure 5B:
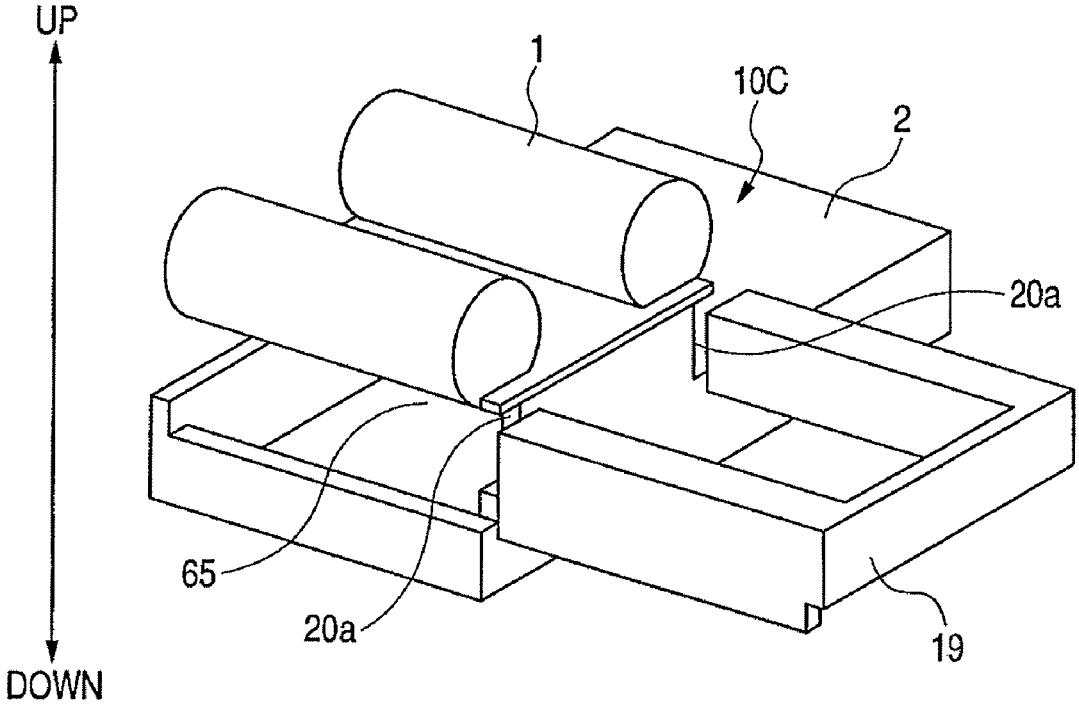

FIGS. 5A and 5B are perspective views illustrating a third embodiment of a consumable cassette according to the present invention, FIG. 5A illustrates that the cassette is removed from a recording apparatus, and FIG. 5B illustrates that the cassette is disposed in the recording apparatus. In FIGS. 5A and 5B, a consumable cassette 10C is provided with a slide member 19 which is slidably movable and which is detachably attached. The slide member 19 is disposed between an ink sheet storage section 1 and a recording material storage section 2 so as to be movable in a direction crossing a recording material conveyance direction. As the movement direction of the slide member 19, a direction in which the consumable cassette 10C is attached to or detached from the recording apparatus is selected. Even in this case, the ink sheet storage section 1 is disposed in a height direction (a front/back surface direction of a recording material) of the recording material storage section 2.

The slide member 19 entirely has a "U"-shape. Moreover, when the consumable cassette 10C is removed from the recording apparatus (a stored state), a space 65 between the recording material storage section 2 and the ink sheet storage section 1 is shielded from the outside by at least three side surfaces except one side surface as shown in FIG. 5A. In consequence, in the stored state, an ink sheet can securely be protected. The slide member 19 also constitutes a reinforcing member of the cassette including a movable member. That is, two side surfaces of the slide member 19 are engaged with slide guide portions 20*a*, 20*a* formed in two portions of the recording material storage section 2. In consequence, rigidity and strength of the consumable cassette 10C are improved. On the other hand, when the consumable cassette 10C is attached to the recording apparatus, the slide member 19 abuts on a protruding portion of the recording apparatus to fall from the consumable cassette as shown in FIG. 5B. The fallen slide member 19 is separately stored. Alternatively, the member may be used as a component constituting the recording apparatus such as a base or a handle. Furthermore, when the consumable cassette 10C is removed from the recording apparatus, a user engages the slide member 19 with the slide guide portions 20*a*, 20*a* to insert the member into the cassette.

Even the present embodiment is directed to the consumable cassette which can easily supply the recording material and the ink sheet to the recording apparatus from one direction. In addition, the cassette can be constituted so as to save a space. Therefore, the cassette is advantageous for miniaturization of the recording apparatus. The consumable cassette can quickly and securely be attached to the recording apparatus, and has an excellent handling property. Furthermore, when the consumable cassette is removed from the recording apparatus, the recording material and the ink sheet can be protected in a state in which dirt (attachment of dust and fingerprint) and crack (deformation and breakage) are not easily generated. This can improve reliability of the consumable cassette.

Fourth Embodiment

Figure 6A:
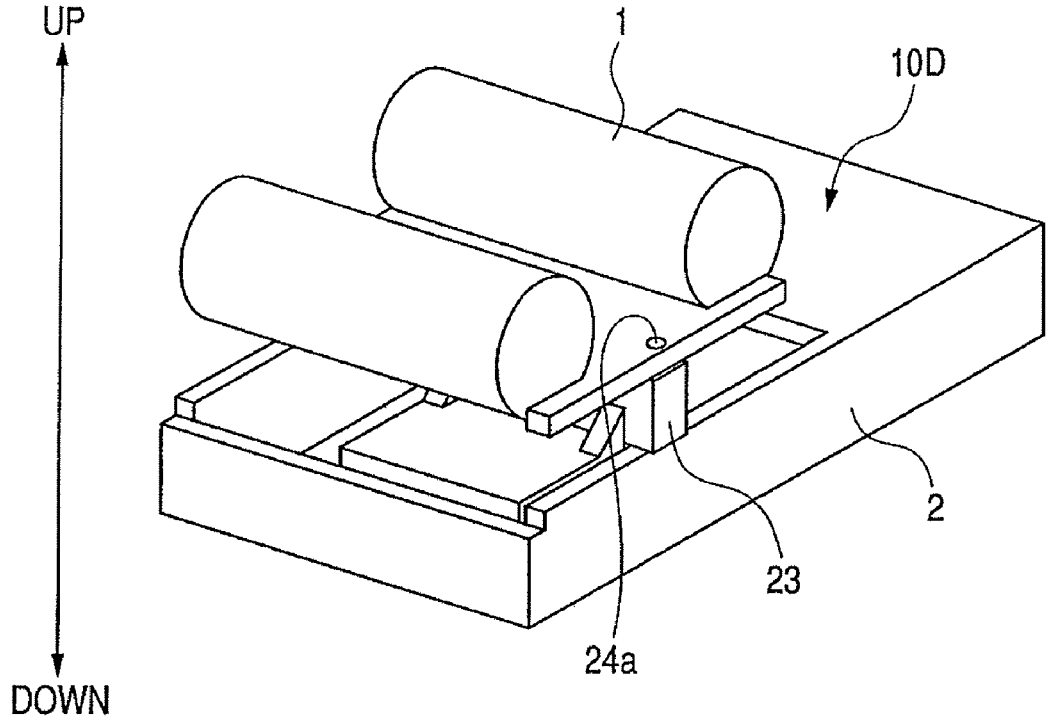
FIGS. 6A and 6B are perspective views schematically illustrating a fourth embodiment of the consumable cassette according to the present invention.
Figure 6B:
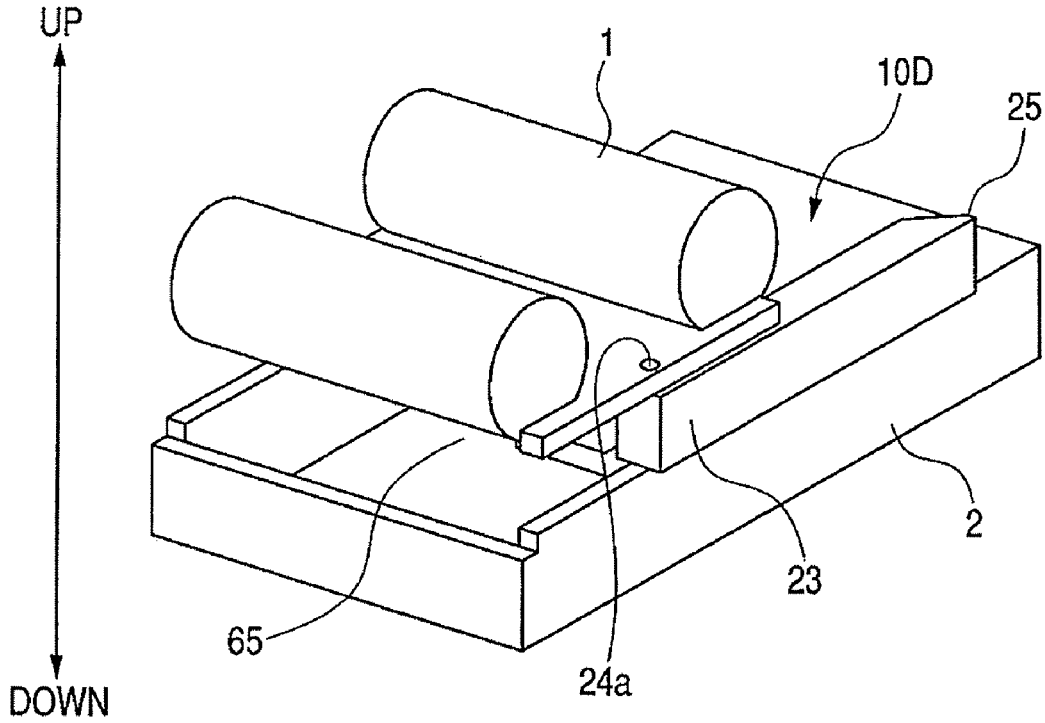

FIGS. 6A and 6B are perspective views illustrating the fourth embodiment of a consumable cassette according to the present invention, FIG. 6A illustrates that the cassette is removed from a recording apparatus, and FIG. 6B illustrates that the cassette is disposed in the recording apparatus. In FIGS. 6A and 6B, a consumable cassette 10D is provided with a rotary member 23 which is disposed between an ink sheet storage section 1 and a recording material storage section 2 and which is rotatable in a horizontal direction centering on a rotary shaft portion 24*a* in a height direction. That is, the ink sheet storage section 1 and the recording material storage section 2 are arranged in a height direction (a front/back surface direction of a recording material) so as to sandwich the rotary member 23. This rotary member 23 also constitutes a reinforcing member of the cassette including a movable member. When the consumable cassette is removed, the rotary member 23 closes a space 65 in the cassette. When the cassette is attached, the member opens the space 65 in the cassette. This rotary member 23 is rotatable in an angle of 0 degree to 90 degrees or more between a closed position shown in FIG. 6A and an opened position shown in FIG. 6B centering on the rotary shaft portion 24*a*.

The recording material storage section 2 and the ink sheet storage section 1 are positioned and connected to each other via the rotary shaft portion 24*a*. The rotary member 23 is urged to the closed position of FIG. 6A by an urging unit such as a torsion spring. Therefore, when the consumable cassette 10D is removed from the recording apparatus, the member quickly moves from the opened position of FIG. 6B to the closed position of FIG. 6A. On the other hand, when the consumable cassette 10D is attached to the recording apparatus, the rotary member 23 abuts on or comes into slide contact with a protruding portion or a guide portion disposed in the recording apparatus to thereby move to the opened position of FIG. 6B.

Moreover, in the closed position of FIG. 6A, in addition to a function of reinforcing the cassette, the rotary member 23 has a function of a support which keeps a constant distance between the ink sheet storage section 1 and the recording material storage section 2. The rotary member 23 also functions as a lid member which cover an ink sheet and the recording material. It is to be noted that in the present embodiment, a distal end portion of the rotary member 23 is provided with a guide portion 25. A linear portion which connects the guide portion 25 to the rotary shaft portion 24*a* is formed with an angle in an attaching/detaching direction. When the consumable cassette 10D is attached to the recording apparatus, the guide portion 25 abuts on a side surface of the recording apparatus. In consequence, a moment centering on the rotary shaft portion 24*a* acts on the rotary member 23. This moment allows the rotary member 23 to move to the opened position where the space 65 is opened.

Even the present embodiment is directed to the consumable cassette by which the recording material and the ink sheet can easily be loaded to the recording apparatus from one direction. In addition, the cassette can be constituted so as to save a space. Therefore, the cassette is advantageous for miniaturization of the recording apparatus. The consumable cassette can quickly and securely be attached to the recording apparatus, and has an excellent handling property. Furthermore, when the consumable cassette is removed from the recording apparatus, the recording material and the ink sheet can be protected in a state in which dirt (attachment of dust and fingerprint) and crack (deformation and breakage) are not easily generated. This can improve reliability of the consumable cassette. Moreover, in the present embodiment, when the rotary member 23 is rotated to the opened position, the member is stored along the side surface of the recording apparatus. Therefore, it is possible to minimize a retracting space to be secured for the rotary member 23 in a direction (a recording apparatus side surface direction) crossing the recording material conveyance direction at right angles.

It is to be noted that in the above embodiments, application of the present invention to the thermal transfer recording apparatus has been described, but the present invention is similarly applicable even to another recording type of recording apparatus as long as two types of consumables, that is, the recording material and the ink sheet are used in the recording apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-040627, filed Feb. 17, 2006, and No. 2007-013383, filed Jan. 24, 2007, which are hereby incorporated by reference herein in their entirety.

What is claimed is:

1. A consumable cassette comprising:

a recording material storage section to store a recording material; and an ink sheet storage section to store an ink sheet, the consumable cassette being detachably attached to a recording apparatus, the recording material storage section and the ink sheet storage section being stacked and being provided with a space formed between the recording material storage section and the ink sheet storage section in a state in which the consumable cassette is attached to the recording apparatus so that a part of a recording mechanism of the recording apparatus is disposed in the space, the consumable cassette further comprising:

a movable member being movable so as to cover the space when the consumable cassette is removed from the recording apparatus and to open the space when the consumable cassette is attached to the recording apparatus.

2. A consumable cassette according to claim 1, wherein the ink sheet storage section is disposed above the recording material storage section via the space in a state in which the recording material storage section is disposed downwards in a gravity direction.

3. A consumable cassette according to claim 1, wherein the recording material is conveyed from the consumable cassette by switchback or a U-turn path.

4. A consumable cassette according to claim 1, wherein when the consumable cassette is removed from the recording apparatus, the movable member regulates movement of the recording material of the recording material storage section to cover the recording material of the recording material storage section and the ink sheet of the ink sheet storage section.

5. A consumable cassette according to claim 1, wherein the movable member is rotatable in an angle range of 0 degree to 90 degrees between the recording material storage section and the ink sheet storage section, and has a function of a support which keeps a constant distance between both of the storage sections and a function of a lid of the recording material storage section.

6. A consumable cassette according to claim 1, wherein the movable member covers the ink sheet of the ink sheet storage section, has a curved surface which forms a part of a conveyance path of the recording material, and is detachably attached to the recording material storage section.

7. A consumable cassette according to claim 1, wherein the movable member is attached movably along a slide guide portion of the recording material storage section, functions as a reinforcing member of the consumable cassette at a time when the cassette is removed from the recording apparatus, and is removed from the recording apparatus at a time when the cassette is attached to the recording apparatus.

8. A consumable cassette according to claim 1, wherein the movable member includes a rotary member rotatable in a horizontal direction between the recording material storage section and the ink sheet storage section, functions as a support which keeps a constant distance between the recording material storage section and the ink sheet storage section at a time when the cassette is removed from the recording apparatus, and is rotated by a guide portion of the recording apparatus to be held by a side edge portion of the recording apparatus in a stored state at a time when the cassette is attached to the recording apparatus.

9. A recording apparatus comprising:

a loading section to which a consumable cassette is to be loaded, the consumable cassette comprising: a recording material storage section to store a recording material; and an ink sheet storage section to store an ink sheet, the recording apparatus further comprising:

a recording mechanism including a recording material conveyance mechanism which operates the recording material storage section, an ink sheet conveyance mechanism which operates the ink sheet storage section and a recording head; and an operation mechanism which allows a movable member to cover a space, when the consumable cassette is removed from the recording apparatus, and to open the space, when the consumable cassette is attached to the recording apparatus, the space being formed between the recording material storage section and the ink sheet storage section in a state in which the consumable cassette constituted by stacking the recording material storage section and the ink sheet storage section is attached to the recording apparatus, a part of the recording mechanism of the recording apparatus being disposed in the space.

10. A recording apparatus according to claim 9, wherein the recording head is a thermal head by which ink is melted and transferred from the ink sheet to the recording material to record an image.

* * * * *